United States Patent [19]

Larson

[11] 3,966,056

[45] June 29, 1976

[54] ARTICLE SUPPORT DEVICE

[75] Inventor: Charles O. Larson, Sterling, Ill.

[73] Assignee: Charles O. Larson Co., Sterling, Ill.

[22] Filed: Mar. 19, 1975

[21] Appl. No.: 559,634

[52] U.S. Cl. ..... 211/134; 248/222; 248/247; 108/92; 108/152

[51] Int. Cl.[2] ..... A47F 5/00

[58] Field of Search ..... 211/90, 134, 148, 177; 248/222, 243, 247, 248, 241, 235, 300; 403/340; 108/54, 92, 152

[56] References Cited

UNITED STATES PATENTS

| | | | |
|---|---|---|---|
| 643,773 | 2/1900 | Metcalf | 248/300 X |
| 2,316,389 | 4/1943 | Atkinson | 248/300 |
| 2,653,783 | 9/1953 | Lindsan | 248/243 |
| 2,772,846 | 12/1956 | Skar | 248/243 |
| 2,933,196 | 4/1960 | Childs | 211/148 |
| 3,085,693 | 4/1963 | Shell | 211/134 |
| 3,190,454 | 6/1965 | Brooks | 248/243 X |
| 3,325,130 | 6/1967 | Smith et al. | 248/247 |
| 3,389,882 | 6/1968 | Schlosser | 211/177 |
| 3,511,106 | 5/1970 | Deeby | 248/222 |
| 3,722,843 | 3/1973 | Enckler | 248/300 |

FOREIGN PATENTS OR APPLICATIONS

| | | | |
|---|---|---|---|
| 867,349 | 12/1952 | Germany | 108/108 |
| 53,207 | 8/1910 | Switzerland | 248/248 |
| 429,511 | 5/1935 | United Kingdom | 248/243 |

*Primary Examiner*—Roy D. Frazier
*Assistant Examiner*—Thomas J. Holko
*Attorney, Agent, or Firm*—Olson, Trexler, Wolters, Bushnell & Fosse, Ltd.

[57] ABSTRACT

The embodiment of the invention disclosed herein is directed to an article support device having a base to support a frame member extending therefrom. A first group of bracket assemblies are secured to the frame member in alignment to support shelves extending thereacross. A second group of similar bracket assemblies are secured to the frame member to provide rigid coupling between the frame member and the base. The bracket assemblies comprise two similar bracket elements L-shaped in their plan view and L-shaped in their cross-section. The two bracket elements are positioned relative to one another to form a U-shaped cross-section with the two bracket elements overlapping at a bight portion. Apertures are formed in each of the bracket elements to overlap at the bight portion. The apertures are oversized and, when the bracket elements are overlapped, the effective diameter of the apertures is reduced to receive a fastener of appropriate size.

8 Claims, 9 Drawing Figures

ARTICLE SUPPORT DEVICE

BACKGROUND OF THE INVENTION

This invention relates generally to article support devices, and more particularly to a shelf support and base structure. More specifically, the invention is directed to a new and improved shelf bracket for use with open frame shelf structures.

Heretofore, free standing shelf structures, such as used in retail stores, and the like, provide a base structure from which extends a vertical wall. Shelves are then secured to the vertical wall on opposite sides thereof in cantilever fashion. Articles placed on the shelves generally are accessible from only one side of the shelf structure as the vertical shelf support wall blocks access to the other side. Furthermore, it is impossible to view articles that are placed on shelves at the other side of the vertical wall.

Accordingly, it is an object of this invention to provide a new and improved shelf structure which enables viewing of articles on diametrically opposed shelves from either side of the shelf structure.

Another object of this invention is to provide a new and improved article support device which is simple and inexpensive to manufacture but strong and reliable in use to accommodate heavy articles.

Still another object of this invention is to provide a new and improved shelf structure which is simple and light in weight to facilitate shipping yet rigid and strong to accommodate heavy articles.

Another object of this invention is to provide an article support shelf bracket which can be shipped in a disassembled condition and then assembled at the site where it is to be used.

A feature of this invention is the utilization of two similar bracket elements L-shaped in their plan view and L-shaped in their cross section. The two bracket elements are positioned relative to one another to become U-shaped in the cross section with the two bracket elements overlapping at the bight portion thereof. Mounting holes in the bight portions overlap and are of a dimension to accommodate slight misalignment of the bracket elements as a result of the thickness of the bracket material. Therefore, identical bracket elements can be made in large quantities and utilized in pairs to provide an extremely strong shelf bracket.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figure 1:
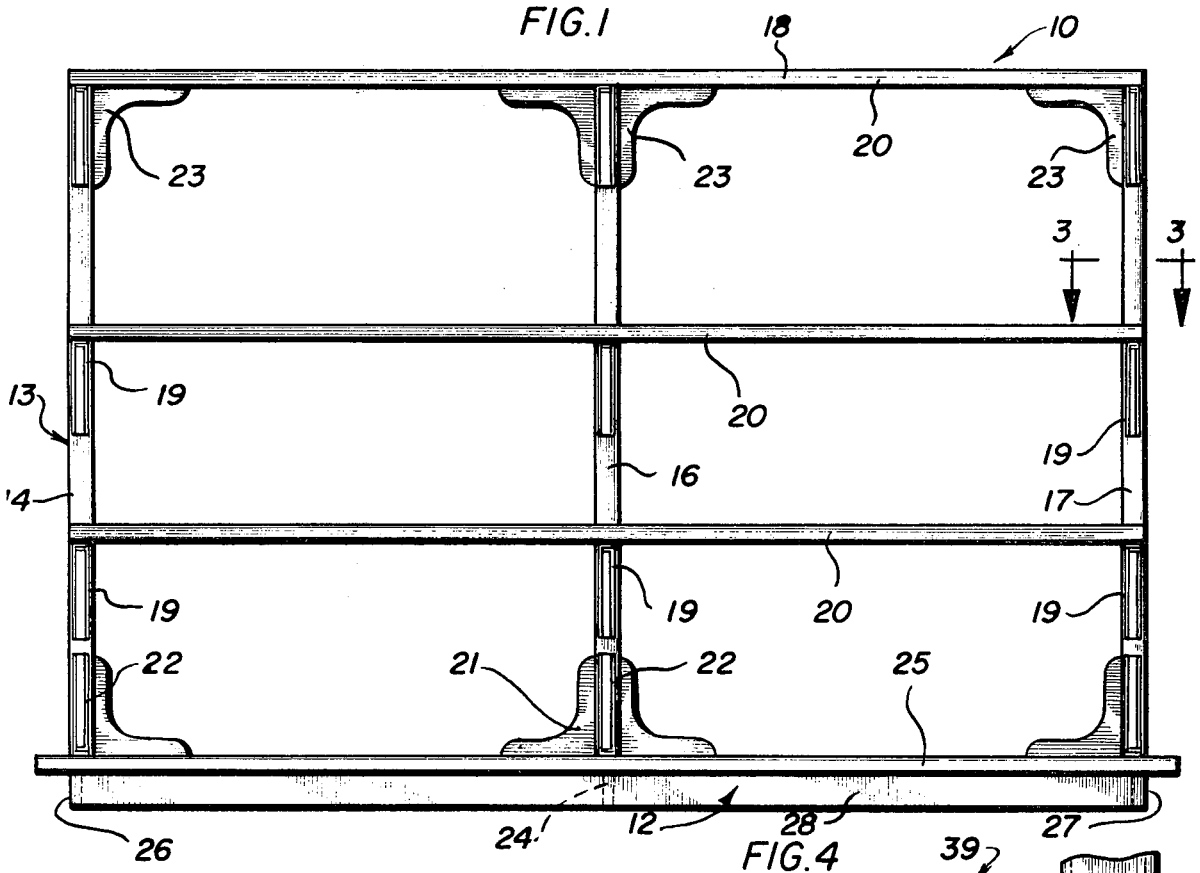
FIG. 1 is a front view of a shelf support stand constructed with the principles of this invention.
Figure 2:
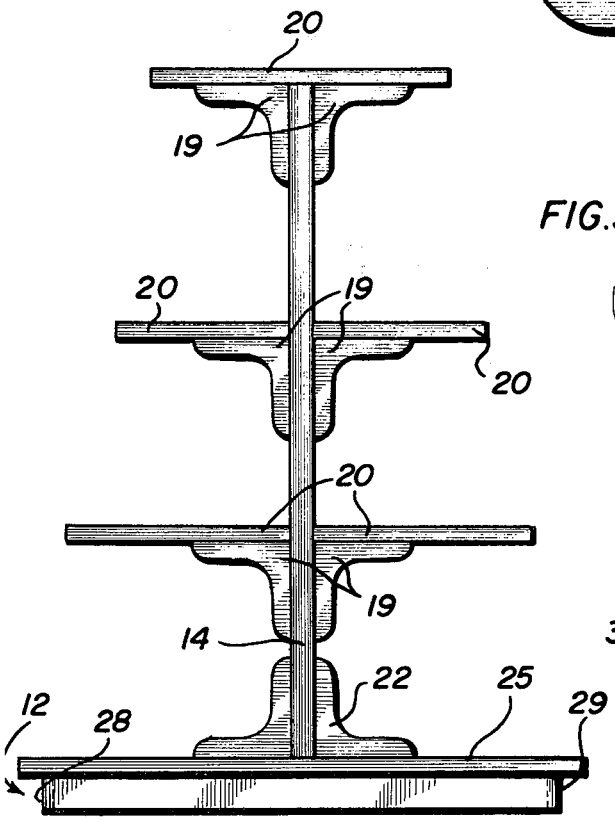
FIG. 2 is a side view of the support stand in FIG. 1.

Referring now to FIGS. 1 and 2, there is seen an article support device constructed in accordance with the principles of this invention and designated generally by reference numeral 10. The article support device 10 includes a base structure 12 for supporting an open frame 13. The open frame 13 allows viewing through the shelf support device from one side to the other side. The frame 13 preferably is formed of vertical posts 14, 16 and 17 secured to the base 12 at their bottom and include a top rail 18 extending therebetween. Preferably the posts 14, 16 and 17 and the top rail 18 are of hollow tubular material, square in the cross section. A plurality of bracket assemblies 19 are secured to the vertical posts 14, 16 and 17 in horizontal alignment and provide means for supporting a plurality of shelves 20.

To provide a rigid vertical support for the frame 13, the bottom of the posts 14, 16 and 17 are secured to the base 12 by brackets 21 and 22, preferably of the same configuration as the shelf brackets 19. Brackets 21 extend lengthwise of the base 12 while brackets 22 extend across the base to provide a four point connection at the center post 16 and a three point connection at the end posts 14 and 17. However, it will be understood the four point connection can also be made at the end posts 14 and 17. The rail 18 is secured to the posts by means of brackets 23, also preferably of the same general configuration as shelf brackets 19. Preferably, the width of the bracket assemblies 19, 21, 22 and 23 are substantially equal to the width of the square tubing forming the posts and top rail. This provides for a more unitary appearance. It also enables an article support device to be constructed of maximum strength with a minimum weight.

The base structure 12 is formed of a top plate member 25 supported by side walls 26 and 27 and front and rear walls 28 and 29, respectively. The base structure 12 therefore is substantially hollow and is relatively light in weight. A center support 24 may be provided if necessary to support heavy loads. By providing an article support device as shown in FIGS. 1 and 2 it can be packaged in a box or carton of minimum size and is relatively light in weight since the entire structure is substantially hollow. The structure is provided with novel shelf support bracket units which provide maximum strength and, therefore, can support heavy loads.

Referring now to FIGS. 3, 4, 5 and 9, there is seen the details of construction of the bracket assembly of this invention. Here, the bracket assemblies 19 include fasteners, such as the bolts 30 and nuts 31, passing therethrough and through the rectangular tubing forming the post 17. It will be understood that this is the same for all bracket assemblies 19 on posts 14 and 16.

Figure 3:
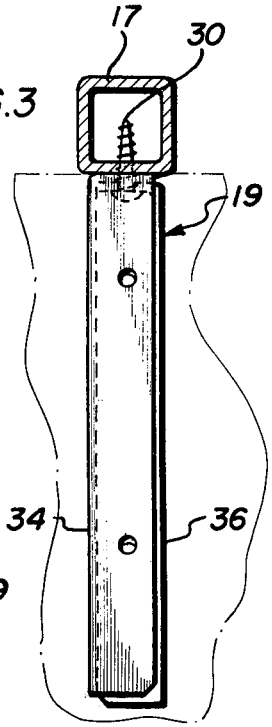
FIG. 3 is a sectional view taken along line 3—3 of FIG. 1 showing a top configuration of a shelf bracket assembly constructed in accordance with the principles of this invention.
Figure 4:
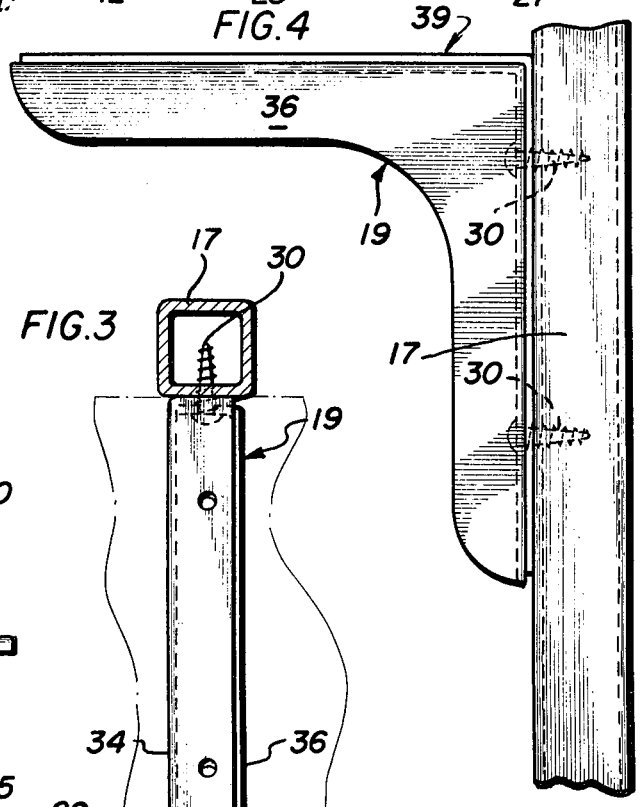
FIG. 4 is a side view of the shelf bracket assembly of FIG. 3.
Figure 5:
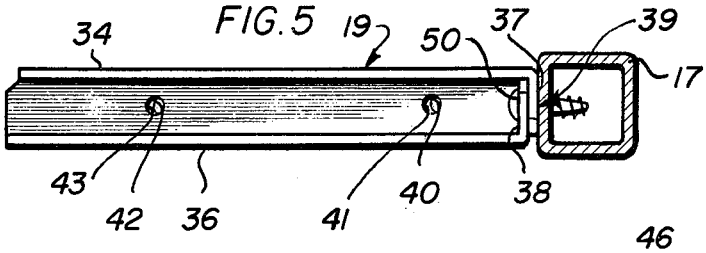
FIG. 5 is an end view of the shelf bracket assembly of FIG. 3.

The bracket assembly 19 is formed by a pair of bracket elements 34 and 36, preferably of substantially identical configuration, and positioned adjacent one another as seen in the drawings. The bracket elements 34 and 36 have top flanges 37 and 38, respectively, overlapping to form a bight portion 39 along the top and rear edge of the bracket assembly. The bight portion is of double thickness and provides increased strength. The bracket elements 34 and 36 are each L-shaped in the plan view, and L-shaped in their cross section. However, when assembled as seen in FIGS. 3, 4 and 5, they provide a substantially U-shaped cross sectional configuration. This has the advantage of partially concealing the heads of the bolts 30.

Figure 6:
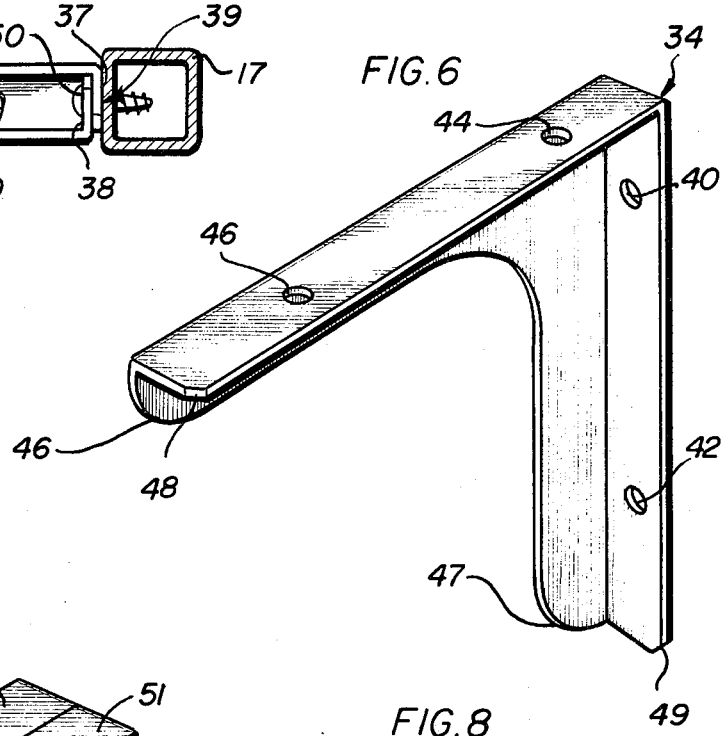
FIG. 6 is a perspective view showing one of the shelf bracket elements used to form the shelf bracket assembly shown in FIGS. 3, 4 and 5.
Figure 9:
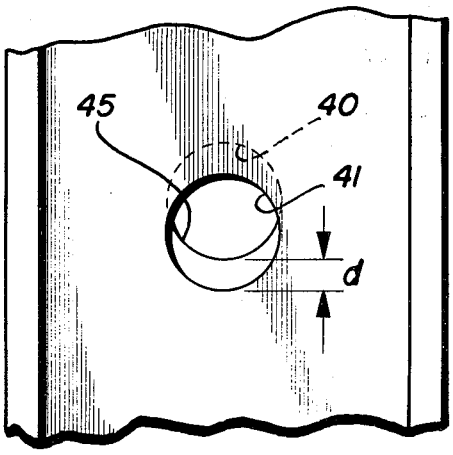
FIG. 9 is an enlarged fragmentary portion of the bracket assembly showing the displacement of the aperture formed therein.

In accordance with the principles of this invention the bracket elements 34 and 36 have apertures 40 and 41 and 42 and 43, respectively, in partial alignment with one another as best seen in FIGS. 5 and 9. These apertures are formed oversize so that as they come into registry with one another they provide an effective aperture size to accommodate the fastener 30, as indicated by reference numeral 45 in FIG. 9. The distance *d* which the apertures 40 and 41 are displaced correspond substantially to the thickness of the material forming the flanges 37 and 38. The bracket assembly 19 of this invention therefore can be made at relatively low cost since both bracket elements are substantially identical in configuration and can be made from the same stamping or forming operation. As best seen in FIG. 6, the bracket element 34 preferably has rounded corners or edges 46 and 47 along its vertical flange portion and chamfered or angled corners 48 and 49 along its horizontal flange portion. The bracket elements 34 and 36 are identical in shape and can be welded together, if desired, to form the assemblies seen in FIGS. 3, 4 and 5 if desired. It will also be understood that the bracket assemblies 21, 22 and 23 can be formed from bracket elements similar to that shown in FIG. 6.

Figure 7:
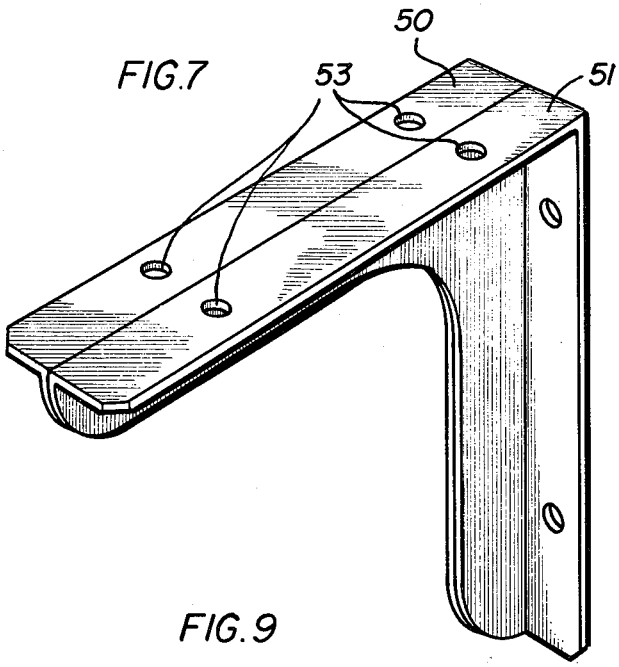
FIGS. 7 and 8 illustrate an alternate use of the shelf bracket elements shown in FIG. 6
Figure 8:
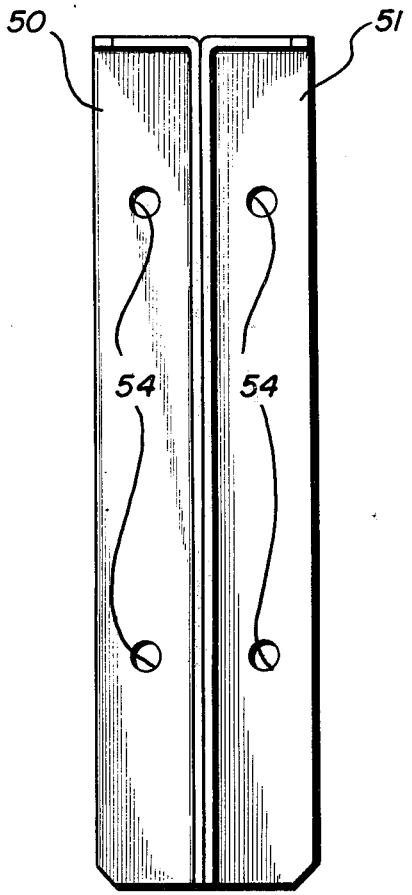

Referring now to FIGS. 7 and 8, there is seen an alternate use for the bracket elements of this invention. Here a pair of bracket elements 50 and 51 are secured together in a side-by-side fashion having mounting holes 53 located along the top portion thereof to secure a shelf thereto and mounting holes 54 located along the vertical flange portions to enable the bracket to be secured to a wall or vertical support frame.

What has been described is a simple and efficient article support device having an open frame structure and a plurality of novel bracket assemblies secured thereto. The invention is also directed to a novel bracket element configuration which enables a plurality of similarly fashioned elements to be assembled into a strong bracket assembly. Accordingly, variations and modifications of this invention may be incorporated without departing from the spirit and scope of the claims as set forth hereinbelow.

The invention is claimed as follows:

1. An article support device, comprising: a base; a frame extending from said base, said frame having at least two spaced apart posts and a rail of substantially the same cross-sectional configuration as said posts and extending therebetween, a first plurality of flanged bracket assemblies secured to said post for supporting shelves thereon, each of said flanged bracket assemblies including two similar flanged brackets having two straight leg elements of equal length and L-shaped in their plan view and each leg L-shaped in its cross-section, said two similar bracket elements being positioned relative to one another to form a U-shape in the cross-section with said two bracket elements overlapping at a bight portion thereof, and two flanges extending outwardly away from said frame and base, and circular apertures formed in each of said bracket elements and extending through the bracket elements overlapping portions but being displaced from one another a distance substantially equal to the flange material thickness to permit insertion of a fastener therethrough and to locate the fastener with its head adjacent the U-shaped bight portion and between the bracket flanges, whereby the fastener is at least partially hidden.

2. An article support device as set forth in claim 1, wherein said apertures are of predetermined diameter, and positioned at the same location in each of said bracket elements, and overlapping of said bight portion displaces said apertures from one another to reduce their effective diameter.

3. An article support device as set forth in claim 1, wherein said two bracket elements are substantially identical in configuration.

4. An article support device as set forth in claim 1 further including a second plurality of bracket assembly secured between said posts and said base for providing rigid connection therebetween, said second plurality being substantially identical with said first plurality of brackets.

5. An article support device as set forth in claim 4 further including a third plurality of bracket assembly secured between said post and said rail to provide a rigid connection therebetween, said third plurality of brackets being substantially identical with said first and second plurality of bracket assemblies.

6. An article support device, comprising: two flanged brackets having two straight leg elements of equal length and L-shaped in their plan view and each L-shaped in its cross-section, said two similar bracket elements being positioned to form a U-shaped crosssection with said two bracket elements overlapping at a bight portion thereof, and circular apertures formed in each of said bracket elements to be in partial registry with one another at said bight portion but displaced from one another a distance substantially equal to the thickness of the flange material to facilitate receiving a fastener for mounting said bracket assembly and to locate the fastener with its head adjacent the bight portion and between the bracket flanges, whereby the fastener is at least partialy hidden.

7. An article support device as set forth in claim 6, wherein said apertures are of predetermined diameter and positioned at the same location in each of said bracket elements, and overlapping of said bight portion displaces said apertures from one another to reduce their effective diameter.

8. An article support device as set forth in claim 6, wherein said two bracket elements are substantially identical in configuration.

* * * * *